US010332452B2

(12) United States Patent
Wang et al.

(10) Patent No.: US 10,332,452 B2
(45) Date of Patent: Jun. 25, 2019

(54) OLED PANEL AND POWER DRIVING SYSTEM ASSOCIATED TO SAME

(71) Applicant: AU Optronics Corporation, Hsin-Chu (TW)

(72) Inventors: Tsang-Hong Wang, Hsin-Chu (TW); Chien-Jen Chen, Hsin-Chu (TW); Chi-Fu Tsao, Hsin-Chu (TW); Yi-Yo Dai, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/719,965

(22) Filed: Sep. 29, 2017

(65) Prior Publication Data

US 2018/0240406 A1 Aug. 23, 2018

(30) Foreign Application Priority Data

Feb. 20, 2017 (TW) ..... 106105532 A

(51) Int. Cl.

| | |
|---|---|
| ***G09G 3/3258*** | (2016.01) |
| ***G09G 3/3275*** | (2016.01) |
| ***G09G 3/3233*** | (2016.01) |
| ***G09G 3/3291*** | (2016.01) |
| *G09G 3/3266* | (2016.01) |

(52) U.S. Cl.

CPC ..... *G09G 3/3258* (2013.01); *G09G 3/3233* (2013.01); *G09G 3/3275* (2013.01); *G09G 3/3291* (2013.01); *G09G 3/3266* (2013.01); *G09G 2300/0819* (2013.01); *G09G 2300/0842* (2013.01); *G09G 2300/0861* (2013.01); *G09G 2310/0289* (2013.01); *G09G 2330/021* (2013.01); *G09G 2330/028* (2013.01)

(58) Field of Classification Search

CPC ..... G09G 2310/0289; G09G 2330/021; G09G 2330/028; G09G 3/3258; G09G 3/3266; G09G 3/3275; G09G 3/3233; G09G 3/3291; G09G 2300/0819; G09G 2300/0842; G09G 2300/0861

See application file for complete search history.

(56) References Cited

U.S. PATENT DOCUMENTS

| | | | | |
|---|---|---|---|---|
| 7,427,985 | B2 | 9/2008 | Chen et al. | |
| 7,589,718 | B2 | 9/2009 | Hu et al. | |
| 9,013,380 | B2 * | 4/2015 | Seo | G09G 3/3208 341/50 |
| 2004/0263446 | A1 | 12/2004 | Kawase et al. | |
| 2007/0285363 | A1 | 12/2007 | Do | |

(Continued)

FOREIGN PATENT DOCUMENTS

CN 101261822 A 9/2008

OTHER PUBLICATIONS

The State Intellectual Property Office(SIPO), "Office Action", dated Sep. 13, 2018.

*Primary Examiner* — Dmitriy Bolotin
(74) *Attorney, Agent, or Firm* — WPAT, PC

(57) ABSTRACT

An OLED panel includes a data driver and an AMOLED. The data driver receives an input voltage and the data driver may generate a data output signal. The AMOLED may receive a positive supply voltage and a negative supply voltage and emit light according to the data output signal. In addition, the input voltage and the positive supply voltage are substantially the same.

9 Claims, 3 Drawing Sheets

(56) References Cited

U.S. PATENT DOCUMENTS

| | | | | |
|---|---|---|---|---|
| 2008/0224965 | A1* | 9/2008 | Kim | G09G 3/3233 345/76 |
| 2008/0252570 | A1* | 10/2008 | Kwon | G09G 3/3233 345/76 |
| 2009/0108744 | A1* | 4/2009 | Park | G09G 3/2011 313/504 |
| 2011/0199366 | A1* | 8/2011 | Tsuchi | G09G 3/3688 345/212 |
| 2011/0316841 | A1* | 12/2011 | Kim | G09G 3/3208 345/212 |
| 2012/0161637 | A1 | 6/2012 | Lee et al. | |
| 2013/0082910 | A1* | 4/2013 | Lee | G09G 3/3208 345/76 |
| 2013/0222713 | A1 | 8/2013 | Park et al. | |
| 2013/0235016 | A1* | 9/2013 | Seo | G09G 3/3208 345/212 |
| 2014/0132589 | A1 | 5/2014 | Min et al. | |
| 2014/0340379 | A1* | 11/2014 | Kim | G09G 3/3225 345/212 |
| 2015/0009198 | A1* | 1/2015 | Park | G09G 3/3233 345/212 |
| 2017/0170726 | A1* | 6/2017 | Lee | G09G 3/2092 |
| 2017/0243534 | A1* | 8/2017 | Zhang | G09G 3/3225 |
| 2017/0294162 | A1* | 10/2017 | Hu | G09G 3/3233 |

* cited by examiner

OLED PANEL AND POWER DRIVING SYSTEM ASSOCIATED TO SAME

BACKGROUND

Technical Field

The present invention relates to a panel and a power driving system thereof, and in particular, to an organic light-emitting diode (OLED) panel and a power driving system associated to same.

Related Art

It is well known that, as compared with a conventional thin film transistor liquid crystal display (TFT LCD) panel, display technologies of active matrix organic light-emitting diode (AMOLED) panels have the advantages of being brighter, having a wider color gamut, and being more energy-saving. Therefore, for smartphones or smartwatches, there has been a tendency of replacing TFT LCD panels with OLED panels.

Referring to FIG. 1, FIG. 1 is a schematic diagram of a conventional OLED panel. An OLED panel 100 includes: an AMOLED 110 and a data driver 120. The data driver 120 includes: a boost circuit 122 and a source driver 124. Certainly, the OLED panel 100 further includes a gate driver and a timing controller. Details are not described herein again.

Generally, to enable the AMOLED 110 to work normally, a positive supply voltage OVDD, which is between approximately 4 V and 5 V (such as 4.6 V), and a negative voltage source OVSS, which is approximately −2.4 V, are provided to the AMOLED 110. In addition, the source driver 124 receives a higher voltage Data_high (such as 5.6 V) and a lower voltage Data_low (such as 3.3V), and generates a data output signal SDout to the AMOLED 110. In other words, a data range of the data output signal SDout is 2.3 V, that is, a voltage difference between the data high voltage Data_high and the data low voltage Data_low (5.6 V-3.3 V=2.3 V).

In addition, an input voltage Vin received by the boost circuit 122 ranges from approximately 2.7 V to 3.6 V. Therefore, the boost circuit 122 needs to boost the input voltage Vin first, and generate the data high voltage Data_high and the data low voltage Data_low that are needed by the source driver 124. Generally, the boost circuit 122 includes at least one charge pump, configured to increase the input voltage Vin by a fixed multiple.

For example, the boost circuit 122 convertes a 2.8 V input voltage Vin double to a 5.6 V data high voltage Data_high, and then supplies the data high voltage Data_high to the source driver 124.

Referring to FIG. 2, FIG. 2 is a schematic diagram of a power driving system of a conventional OLED panel. Because the AMOLED 110 needs a relatively great loading current during operation, a circuit board 200 needs at least two power chips. As shown in the figure, the circuit board 200 includes: an analog power IC 210 and an OLED power IC 220.

The OLED power IC 220 receives a battery voltage Vbat, generates a positive supply voltage OVDD and a negative supply voltage OVSS, and supplies to the AMOLED 110 of the OLED panel 100.

Further, the analog power IC 210 receives the battery voltage Vbat, generates an input voltage Vin, and supplies to all drivers, such as the data driver 120 and a gate driver (not shown), of the OLED panel 100. Therefore, the power driving system of a conventional OLED panel is a power driving system having two chips.

Basically, when a smartphone or a smartwatch is in a standby state, the analog power IC 210 and the OLED power IC 220 still need to supply a quiescent current. In this way, a power driving system having two chips consumes power due to the quiescent current. In addition, in the conventional OLED panel 100, the boost circuit 122 in the data driver performs a boost operation on the input voltage Vin, and causes additional power consumption on, for example, a 2×Vin or 3×Vin level.

SUMMARY

An embodiment of the present invention relates to an OLED panel, including a data driver and an AMOLED. The data driver may receive an input voltage and generate a data output signal. The AMOLED receives a positive supply voltage and a negative supply voltage, and emits light according to the data output signal. The input voltage and the positive supply voltage are substantially the same.

An embodiment of the present invention relates to a power driving system of an OLED panel, including an OLED panel and a circuit board. The circuit board is provided with a power chip thereon, and the power chip receives a battery voltage and generates a positive supply voltage, a negative supply voltage, and an input voltage. The circuit board may be electrically connected to the OLED panel, and the input voltage and the positive supply voltage are substantially the same.

An embodiment of the present invention relates to an OLED panel, including an OLED pixel circuit, a data driver and a circuit board. The OLED pixel circuit includes an OLED, and has an anode and a cathode. The data driver is electrically connected to the OLED pixel circuit. The circuit board has a power chip. The power chip has an input pin, a first output pin, a second output pin, and a third output pin. The first output pin is electrically connected to the data driver. The second output pin is electrically to the anode terminal. The third output pin is electrically connected to the cathode terminal.

To better understand the foregoing and other aspects of the embodiments of the present invention, preferred embodiments accompanied with figures are described in detail below.

DETAILED DESCRIPTION

Figure 1:
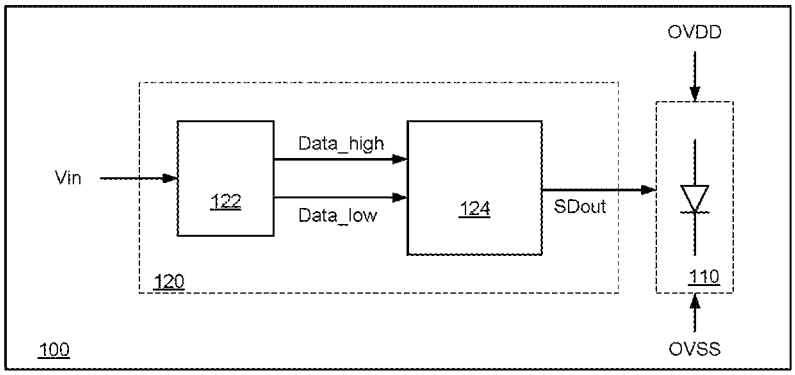
FIG. 1 is a schematic diagram illustrating a conventional OLED panel.
Figure 2:
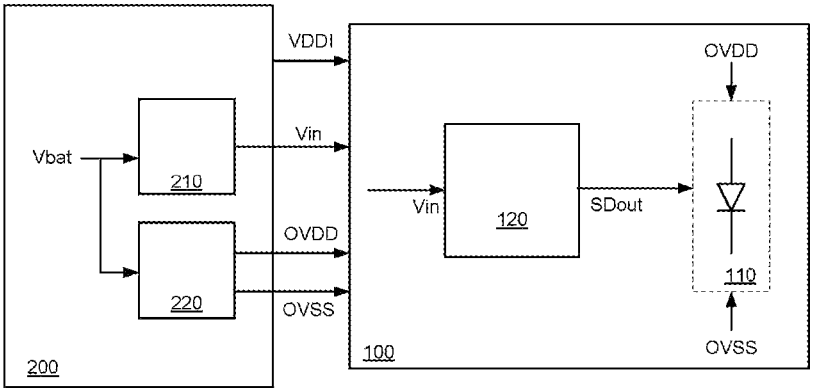
FIG. 2 is a schematic diagram illustrating a power driving system of a conventional OLED panel.
Figure 3A:
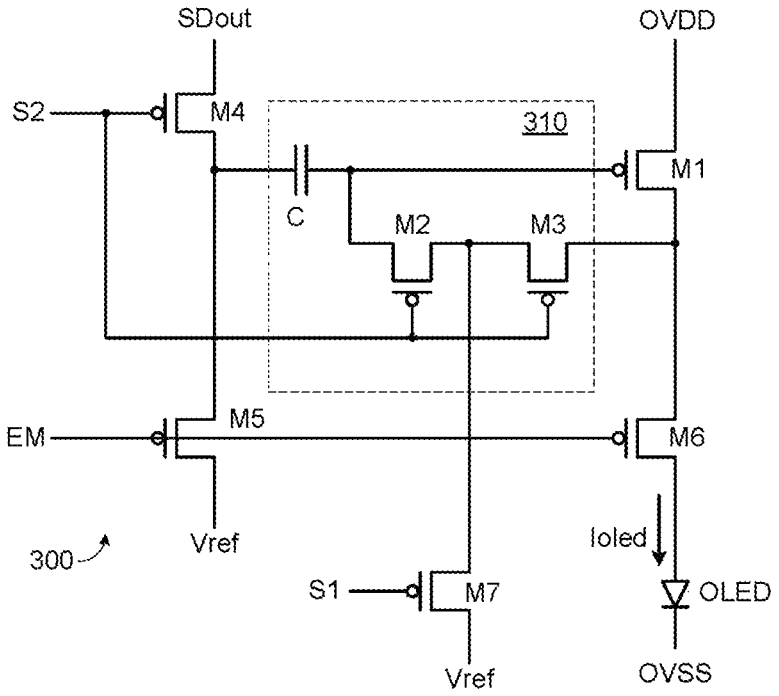
FIG. 3A and FIG. 3B are schematic diagrams illustrating a pixel circuit applied to an OLED panel and relevant signals thereof according to an embodiment of the present invention.
Figure 3B:
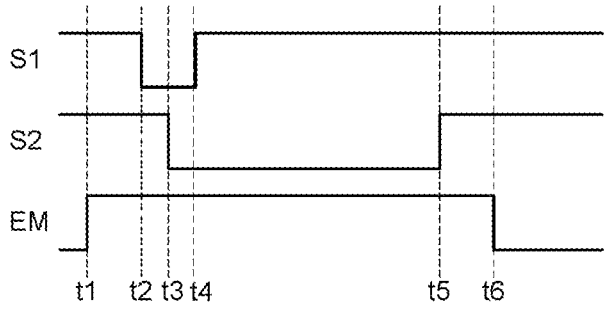

Referring to FIG. 3A and FIG. 3B, FIG. 3A and FIG. 3B are schematic diagrams illustrating a pixel circuit applied to an OLED panel and relevant signals thereof according to an embodiment of the present invention.

A pixel circuit 300 includes a plurality of transistors, an OLED, and a compensation circuit 310. A first terminal of a transistor M1 receives a positive supply voltage OVDD, and a gate is electrically connected to the compensation circuit 310. A first terminal of a transistor M6 is electrically connected to a second terminal of the transistor M1, and a gate receives a control signal EM. An anode terminal of the OLED is electrically connected to a second terminal of the transistor M6, and a cathode terminal is electrically connected to a negative supply voltage OVSS. A first terminal of a transistor M4 receives a data output signal SDout, a gate receives a control signal S2, and a second terminal of the transistor M4 is electrically connected to the compensation circuit 310. A first terminal of a transistor M5 is electrically connected to the second terminal of the transistor M4, a gate receives the control signal EM, and a second terminal of the transistor M5 receives a reference voltage Vref. A first terminal of a transistor M7 is electrically connected to the compensation circuit 310, a gate receives a control signal S1, and a second terminal receives the reference voltage Vref.

The compensation circuit 310 includes a capacitor C and transistors M2 and M3. One terminal of the capacitor C is electrically connected to the second terminal of the transistor M4, and another terminal of the capacitor C is electrically connected to the gate of the transistor M1. The first terminal of the transistor M2 is electrically connected to the gate of the transistor M1, the gate receives a control signal S2, and the second terminal of the transistor M2 is electrically connected to the first terminal of the transistor M7. The first terminal of the transistor M3 is electrically connected to the first terminal of the transistor M7, the gate receives the control signal S2, and the second terminal of the transistor M3 is electrically connected to the second terminal of the transistor M1.

According to this embodiment of the present invention, the compensation circuit 310 in the pixel circuit 300 is configured to compensate for a threshold voltage of the transistor M1. Further, the reference voltage Vref is an adjustable bias signal. When the data output signal SDout is generated, an OLED current holed generated by the transistor M1 is enabled to be proportional to $(SDout-Vref)^2$.

As shown in FIG. 3B, before a time point t1, the control signal EM is on a low level, the control signals S1 and S2 are on a high level, and the second terminal of the transistor M4 has the reference voltage Vref. Between the time point t1 and a time point t2, the control signals EM, S1, and S2 are all on a high level, and the second terminal of the transistor M4 is maintained at the reference voltage Vref. Between the time point t2 and a time point t3, the control signal S1 is on a low level, and the control signals EM and S2 are on a high level, so that the transistor M7 provides the reference voltage Vref to the compensation circuit 310.

Between the time point t3 and a time point t4, the control signals S1 and S2 are on a low level, and the control signal EM is on a high level, so that the transistor M4 provides the data output signal SDout to the compensation circuit 310. Between the time point t4 and a time point t5, the control signal S2 still keep a low level, and the control signals S1 and EM are on a high level, so that the compensation circuit 310 performs threshold voltage compensation. Between the time point t5 and a time point t6, the control signals S1, S2, and EM are all on a high level, so that compensation for the transistor M1 is completed. At a time point t6, the control signal EM is on a low level, and the control signals S1 and S2 are on a high level, so that the transistor M1 generates an OLED current holed and sends it to the OLED. The OLED current holed is approximately equal to $\beta\times(SDout-Vref)^2$, and $\beta$ is a device parameter of the transistor M1.

According to the foregoing description, it can be known that attributes of the pixel circuit 300 of this embodiment of the present invention are derived from the OLED current holed, which depends on a difference between the data output signal SDout and the reference voltage Vref. To maintain light-emitting attributes of the OLED, a substantially same OLED current bled needs to be formed. Therefore, to maintain light-emitting attributes of the OLED, a substantially same voltage difference between the data output signal SDout and the reference voltage Vref needs to be maintained. In this case, a lower operating level of the OLED is obtained by further adjusting a value of the reference voltage Vref. For example, when the same light-emitting attributes of the OLED are maintained and the reference voltage Vref is reduced, an operating voltage of the data output signal SDout also is adjusted to a lower voltage region. When the reference voltage Vref is 1 V, the data high voltage Data_high is adjusted to 2.8 V and the data low voltage Data_low is 0.5 V. It results an operating range of the data output signal SDout is also maintained at 2.3 V.

However, according to the foregoing voltage instances, when the data high voltage Data_high is 2.8 V and the data low voltage Data_low is 0.5 V, the data driver does not need a boost circuit to increase the input voltage Vin, and power consumption of the data driver is effectively reduced. The pixel circuit 300 shown in FIG. 3A is an embodiment of the present invention, but the present invention is not limited thereto. Specifically, the pixel circuit 300 is considered to be a circuit that has the reference voltage Vref as a DC offset signal attribute, and adjusts the reference voltage Vref. Therefore, if other pixel circuits have same attributes, the reference voltage Vref can also be easily adjusted, so as to affect an operating voltage of the data output signal SDout.

Figure 4:
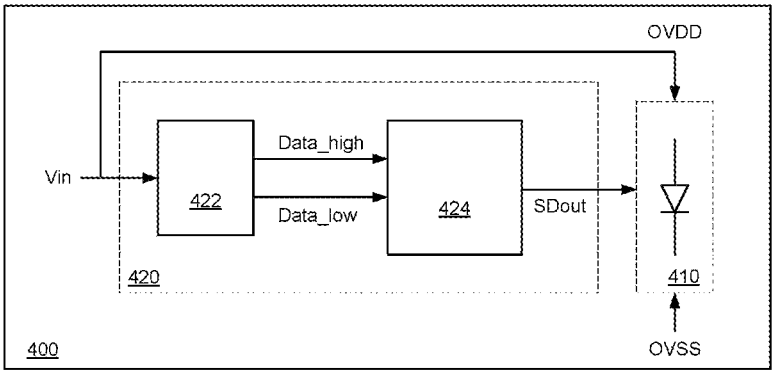
FIG. 4 is a schematic diagram illustrating an OLED panel according to an embodiment of the present invention.

Referring to FIG. 4, FIG. 4 is a schematic diagram illustrating an OLED panel according to an embodiment of the present invention. An OLED panel 400 includes: an AMOLED 410 and a data driver 420. The data driver 420 further includes a voltage step-down circuit 422 and a source driver 424. In addition, the OLED panel 400 further includes a gate driver and a timing controller. However, details are not described herein again.

In this embodiment of the present invention, when an operating voltage of a data output signal SDout generated by the data driver 420 is adjusted to a low voltage, an input voltage Vin received by the data driver 420 is reduced. In this way, the input voltage Vin not only can be provided to the data driver 420 to form the data output signal SDout, but also can be provided for a positive supply voltage OVDD of the AMOLED 410. For example, the positive supply voltage OVDD of the AMOLED 410 is approximately 3.3 V, and the negative supply voltage OVSS. According to the embodiment of FIG. 3A, the data high voltage Data_high of the operating voltage range of the data output signal SDout is 2.8 V, and the data low voltage Data_low of the operating voltage range of the data output signal SDout is 0.5 V, so that the operating voltage (2.8 V to 0.5 V) of the data output signal SDout is less than the positive supply voltage OVDD (3.3 V). In this way, when the data driver 420 receives the 3.3 V of the input voltage Vin, a proper operating voltage provided to generate the data output signal SDout. At the same time, the input voltage Vin also is provided to the AMOLED 410 as the positive supply voltage OVDD.

Specifically, referring to the embodiment of FIG. 4, the data driver 420 includes the voltage step-down circuit 422 and the source driver 424, and the data driver 420 receives the input voltage Vin to generate the data output signal SDout. The positive supply voltage OVDD is greater than or substantially equal to the operating voltage range of the data output signal SDout. That is, the positive supply voltage OVDD is respectively greater than or substantially equal to the data high voltage Data_high and the data low voltage Data_low. Therefore, the data driver 420 is provided with the voltage step-down circuit 422 to buck the input voltage Vin to form the data high voltage Data_high and the data low voltage Data_low. As compared with the conventional OLED panel, in the OLED panel 400 of this embodiment of the present invention, the data driver 422 does not need a boost circuit to increase the input voltage Vin, so that power consumption of the OLED panel 400 is effectively reduced.

Specifically, in this embodiment, the voltage step-down circuit 422 uses a low dropout regulator (LDO) to convert the input voltage Vin into a data high voltage Data_high and a data low voltage Data_low. For ease of description, FIG. 4 of this embodiment shows and expresses a signal or voltage connection relationship rather than metal wiring of actual objects.

Figure 5:
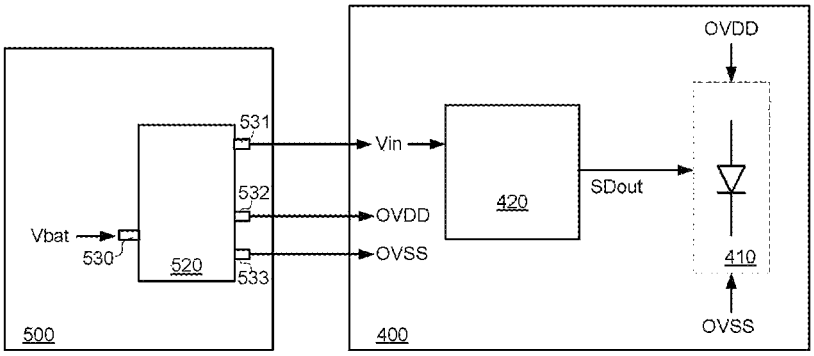
FIG. 5 is a schematic diagram illustrating a power driving system of an OLED panel according to an embodiment of the present invention.

Referring to FIG. 5, FIG. 5 is a schematic diagram illustrating a power driving system of an OLED panel according to an embodiment of the present invention. Because an input voltage Vin on an OLED panel 400 is substantially the same as a positive supply voltage (OVDD), for example, approximately 3.3V, a power chip is disposed on a circuit board 500, and such a single power chip can provide three groups of power supplies to the OLED panel 400. As shown in the figure, the circuit board 500 combined with the OLED panel 400 includes: a power chip 520. In this embodiment, the circuit board 500 is a printed circuit board (PCB) or a flexible printed circuit (FPC) board, but the present invention is not limited thereto. The circuit board 500 also is any carrier provided with metal wiring or capable of transmitting or conducting an electric signal.

In other words, the power chip 520 receives a battery voltage Vbat, and generates a positive supply voltage OVDD and a negative supply voltage OVSS, to provide them to an AMOLED 410. In the embodiment of the invention, an OLED power IC 520 also generates an input voltage Vin to provide it to a data driver 420. In this embodiment of the FIG. 5, the power chip 520 includes a buck boost converter, an input terminal as the battery voltage Vbat and three output terminals as the input voltage Vin, the positive supply voltage OVDD, and the negative supply voltage OVSS. The input voltage Vin is substantially the same as the positive supply voltage OVDD. However, the present invention is not limited thereto. Different circuits is used according to different designs, to achieve the function that the input voltage Vin can be substantially the same as the voltage of the positive supply voltage OVDD.

Specifically, in this embodiment, the power chip 520 includes an input pin 530, a first output pin 531, a second output pin 532, and a third output pin 533. The battery voltage Vbat is transmitted to an input pin 530, and various voltages are generated by means of the power chip 520 to be provided to the OLED panel 400. The first output pin 531 correspondingly generates the input voltage Vin,the second output pin 532 correspondingly generates the positive supply voltage OVDD, and the third output pin 533 correspondingly generates the negative supply voltage OVSS. Voltages formed by the first output pin 531 and the second output pin 532 are substantially the same. In this embodiment, when the same voltage is generated by different two pins, it results the two pins with the same voltage is separately controlled in timings to facilitate application to the OLED panel 400. As compared with the power driving system of the conventional OLED panel, the OLED panel 400 in the embodiment of the present invention needs only three groups of power supplies to work normally. That is, the power driving system of the OLED panel in the embodiment of the present invention is a power driving system having 1 IC and 3 channels.

According to the foregoing description, it is known that the advantage of the embodiments of the present invention lies in providing an OLED panel and a power driving system associated to same. On the OLED panel, the data driver 420 only needs to buck the input voltage Vin, and does not need to boost the input voltage Vin, to reduce power consumption.

In addition, the reference voltage Vref is appropriately adjusted by means of the pixel circuit, so as to make the positive supply voltage OVDD of the AMOLED substantially the same as the input voltage Vin. In this way, the power driving system in the embodiment of the present invention is a power driving system having 1 IC and 3 channels.

Further, the voltage values mentioned above are not intended to limit the present invention. A person skilled in the art may make modifications according to voltage values mentioned in the OLED panel and power driving system that are disclosed in the present invention and implement the present invention. In addition, the connection, electrical connection, coupling, electrical coupling, and the like mentioned above are considered as direct relationships only when they are particularly described to be direct, such as direct connection, that is, there is no other object therebetween.

Based on the above, the present invention is disclosed through the foregoing embodiments; however, these embodiments are not intended to limit the present invention. A person of ordinary skill in the technical field to which the present invention belongs can make various changes and modifications without departing from the spirit and scope of the present invention. Therefore, the protection scope of the present invention is subject to the appended claims.

What is claimed is:

1. An organic light-emitting diode (OLED) panel, comprising:

a data driver, receiving an input voltage via one and only one voltage conduit and generating a data output signal; and an active matrix organic light emitting display (AMOLED), receiving a positive supply voltage and a negative supply voltage, and emitting light according to the data output signal, wherein the input voltage and the positive supply voltage are the same voltage;

wherein the AMOLED has an OLED pixel circuit, comprises:

a compensation circuit;

a first transistor, wherein the first transistor's first terminal is electrically connected to the positive supply voltage, and the first transistor's gate is electrically connected to the compensation circuit;

a sixth transistor, wherein sixth transistor's first terminal is electrically connected to the first transistor's second terminal, and the sixth transistor's gate receives a first control signal;

an OLED, having an anode terminal and a cathode terminal, wherein the anode terminal is electrically connected to the sixth transistor's second terminal, and the cathode terminal is electrically connected to the negative supply voltage;

a fourth transistor, wherein the fourth transistor's first terminal receives the data output signal, the fourth transistor's gate receives a second control signal, and the fourth transistor's second terminal is electrically connected to the compensation circuit;

a fifth transistor, wherein the fifth transistor's first terminal is electrically connected to the fourth transistor's second terminal, the fifth transistor's gate receives the first control signal, and the fifth transistor's second terminal receives a reference voltage; and a seventh transistor, wherein the seventh transistor's first terminal is electrically connected to the compensation circuit, the seventh transistor's gate receives a third control signal, and the seventh transistor's second terminal receives the reference voltage.

2. The organic light-emitting diode (OLED) panel according to claim 1, wherein the OLED pixel circuit comprises a compensation circuit, the compensation circuit comprising:

a capacitor, wherein the capacitor's first terminal is electrically connected to a fourth transistor's second terminal, and the capacitor's second terminal is electrically connected to a first transistor's gate;

a second transistor, wherein the second transistor's first terminal is electrically connected to the first transistor's gate, the second transistor's gate receives a second control signal, and the second transistor's second terminal is electrically connected to a seventh transistor's first terminal; and a third transistor, wherein the third transistor's first terminal is electrically connected to the seventh transistor's first terminal, the third transistor's gate receives the second control signal, and the third transistor's second terminal is electrically connected to the first transistor's second terminal.

3. The OLED panel according to claim 1, wherein the AMOLED further comprises an OLED, and an anode terminal of the OLED is electrically connected to the positive supply voltage, and a cathode terminal of the OLED is electrically connected to the negative supply voltage.

4. The OLED panel according to claim 1, wherein the data output signal is at a first voltage, the input voltage is at a second voltage, and the first voltage is less or equal to the second voltage.

5. A power driving system of an OLED panel, comprising:

an OLED panel; and a circuit board, wherein the circuit board is provided with a power chip thereon, the power chip receives a battery voltage and generates a positive supply voltage, a negative supply voltage, and an input voltage, wherein the circuit board is electrically connected to the OLED panel, and the input voltage and the positive supply voltage are same;

an AMOLED, wherein the AMOLED has an OLED pixel circuit, the OLED pixel circuit comprising:

a compensation circuit;

a first transistor, wherein the first transistor's first terminal is electrically connected to the positive supply voltage, and the first transistor's gate is electrically connected to the compensation circuit;

a sixth transistor, wherein the sixth transistor's first terminal is electrically connected to the first transistor's second terminal, and the sixth transistor's gate receives a first control signal;

an OLED, having an anode terminal and a cathode terminal, wherein the anode terminal is electrically connected to the sixth transistor's second terminal, and the cathode terminal is electrically connected to the negative supply voltage;

a fourth transistor, wherein the fourth transistor's first terminal receives the data output signal, the fourth transistor's gate receives a second control signal, and the fourth transistor's second terminal is electrically connected to the compensation circuit;

a fifth transistor, wherein the fifth transistor's first terminal is electrically connected to the fourth transistor's second terminal, the fifth transistor's gate receives the first control signal, and the fifth transistor's second terminal receives a reference voltage; and a seventh transistor, wherein the seventh transistor's first terminal is electrically connected to the compensation circuit, the seventh transistor's gate receives a third control signal, and the seventh transistor's second terminal receives the reference voltage.

6. The power driving system of an OLED panel according to claim 5, wherein the OLED pixel circuit has an anode terminal and a cathode terminal, wherein the anode terminal is connected to the positive supply voltage, and the cathode terminal is connected to the negative supply voltage.

7. The power driving system of an OLED panel according to claim 5, further comprising:

a data driver, disposed on the OLED panel, and generates a data output signal, wherein the data driver comprises:

a voltage step-down circuit, receiving the input voltage, and generating a data high voltage and a data low voltage; and a source driver, receiving the data high voltage and the data low voltage, and making an operating range of the data output signal from the data high voltage to the data low voltage.

8. The power driving system for an OLED panel according to claim 7, wherein the data output signal is at a first voltage, the input voltage is at a second voltage, and the first voltage is less or equal to the second voltage.

9. The power driving system of an OLED panel according to claim 5, wherein the power chip has an input pin, a first output pin, a second output pin, and a third output pin; and wherein the first output pin and the second output pin output a same voltage.

* * * * *